US005990433A

United States Patent [19]

Alden, III et al.

[11] Patent Number: 5,990,433

[45] **Date of Patent: *Nov. 23, 1999**

[54] MOLDED ELECTRICAL SWITCH

[75] Inventors: Wayne S. Alden, III, Whitman, Mass.; David R. Crotzer, Nashua, N.H.; Arnie Feinberg, Stoughton, Mass.

[73] Assignee: Thomas & Betts International, Inc., Sparks, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/992,756

[22] Filed: Dec. 17, 1997

[51] Int. Cl.[6] ..... H01H 13/70

[52] U.S. Cl. ..... 200/345; 200/511

[58] Field of Search ..... 200/345, 511, 200/516, 5 A, 8 R, 11 R, 11 TW, 16 R–16 F, 503, 512–517, 537–552, 264

[56] References Cited

U.S. PATENT DOCUMENTS

| | | | |
|---|---|---|---|
| 3,707,609 | 12/1972 | Dapot et al. | 200/5 R |
| 3,728,509 | 4/1973 | Shimojo | 200/159 R |
| 3,950,627 | 4/1976 | Murata et al. | 200/159 R |
| 5,008,505 | 4/1991 | Takano et al. | 200/531 |
| 5,063,277 | 11/1991 | Takano et al. | 200/531 |
| 5,430,267 | 7/1995 | Ozeki et al. | 200/302.2 |
| 5,430,297 | 7/1995 | Ozeki et al. | 200/302.3 |
| 5,493,082 | 2/1996 | Bloch et al. | 200/16 A |
| 5,512,717 | 4/1996 | Magome et al. | 200/295 |
| 5,777,281 | 7/1998 | Riddiford | 200/5 A |

*Primary Examiner*—Michael L. Gellner
*Assistant Examiner*—Nhung Nguyen
*Attorney, Agent, or Firm*—Weingarten, Schurgin, Gagnebin & Hayes LLP

[57] ABSTRACT

Several different types of electrical switches are disclosed. In one particular embodiment, an electrical switch is disclosed comprising: a molded case having a pair of conductive terminal contacts; and a molded actuator for mating with the case. The actuator is movable between a conducting position and a non-conducting position within the case, and the actuator has at least one spring member and a conductive contact surface. The spring member forces the actuator into the non-conducting position, and the conductive contact surface provides an electrical connection between the pair of conductive terminal contacts when the actuator is in the conducting position. The actuator is retained within the case by a retaining member and/or a snap member. The case and the actuator are molded about the conductive terminal contacts and the spring members, respectively. Furthermore, the conductive contact surface is formed of a conductive elastomer that is grafted to the actuator. In other embodiments, the spring members are molded as a part of the actuator or the case, or the spring members are connected to the conductive contact surface or the conductive terminal contacts with the actuator and the case being molded thereabout, respectively.

24 Claims, 11 Drawing Sheets

MOLDED ELECTRICAL SWITCH

CROSS-REFERENCE TO RELATED APPLICATIONS

Not Applicable

STATEMENT REGARDING FEDERALLY SPONSORED RESEARCH OR DEVELOPMENT

Not Applicable

FIELD OF INVENTION

The present invention relates generally to electrical switches and, more particularly, to a molded electrical switch that can be produced in high volumes with a minimum number of fabrication steps.

BACKGROUND OF THE INVENTION

The use of electrical switches is widespread in the present electronic age. Simple electrical switches are used for a variety of purposes ranging from household appliances to complex computer circuitry. These simple electrical switches must be inexpensive to manufacture and must be produced in large quantities to fill large demands.

To date, most simple electrical switches are fabricated with separate molded non-conductive components and conductive contact elements. These molded non-conductive components and conductive elements are typically assembled together at some time after the molded components have cured. Thus, at least two fabrication steps are required for these simple electrical switches: a molding step and an assembling step.

Furthermore, there are currently no electrical switches available which have a conductive elastomer grafted directly to a molded non-conductive component thereof. Such a conductive elastomer could provide an conducting contact surface for an electrical switch. Additionally, the conductive elastomer could be grafted to the molded non-conductive component of the electrical switch during the processing of the molded non-conductive component of the electrical switch, thereby shortening or eliminating a fabrication step.

In view of the foregoing, it would be desirable to provide a molded electrical switch that can be produced in high volumes with a minimum number of fabrication steps.

SUMMARY OF THE INVENTION

The present invention contemplates several types of electrical switches. In one embodiment, the present invention is realized as an electrical switch comprising: a molded case having a pair of conductive terminal contacts; and a molded actuator for mating with the case, wherein the actuator is movable between a conducting position and a non-conducting position within the case, wherein the actuator has at least one spring member and a conductive contact surface, wherein the spring member forces the actuator into the non-conducting position, and wherein the conductive contact surface provides an electrical connection between the pair of conductive terminal contacts when the actuator is in the conducting position. The actuator is retained within the case by a retaining member and/or a snap member. The case and the actuator are molded about the conductive terminal contacts and the spring members, respectively. Furthermore, the conductive contact surface is formed of a conductive elastomer that is grafted to the actuator.

In other embodiments, the spring members are molded as a part of the actuator or the case, or the spring members are connected to the conductive contact surface or the conductive terminal contacts with the actuator and the case being molded thereabout, respectively. Further embodiments are also disclosed.

In view of the foregoing, it is quite apparent that the present invention overcomes the shortcomings of the above-mentioned prior art, and that the primary object of the present invention is to provide molded electrical switch that can be produced in high volumes with a minimum number of fabrication steps.

The above-stated primary object, as well as other objects, features, and advantages, of the present invention will become readily apparent from the following detailed description which is to be read in conjunction with the appended drawings.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF THE INVENTION

Figure 1:
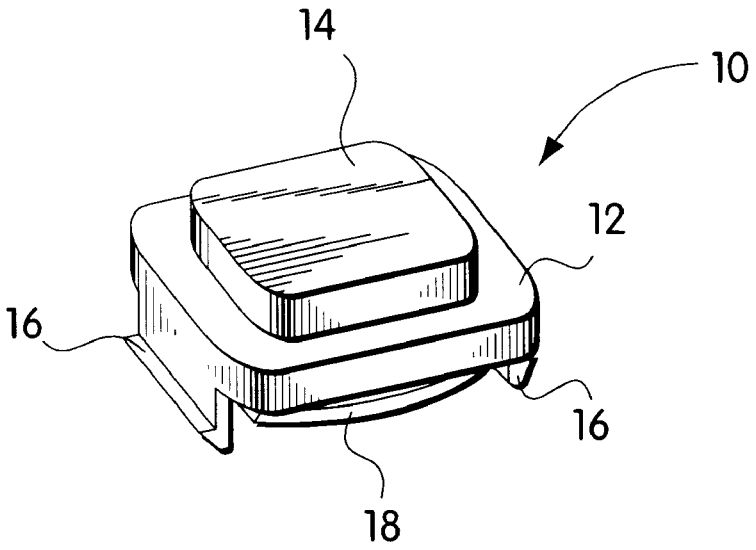
FIG. 1 is a top perspective view of an actuator for a two-piece pushbutton switch in accordance with the present invention.
Figure 2:
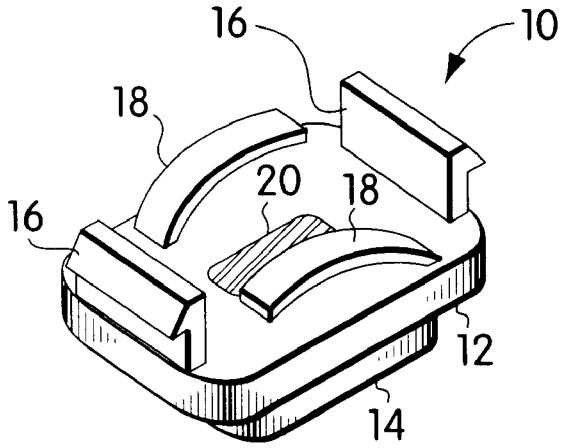
FIG. 2 is a bottom perspective view of the actuator shown in FIG. 1.

Referring to FIGS. 1 and 2, there are shown top and bottom perspective views, respectively, of an actuator 10 for a two-piece pushbutton switch in accordance with the present invention. The actuator 10 comprises a main body portion 12, an elevated finger button 14, a pair of retaining members 16, a pair of spring members 18, and a conductive contact 20. The main body portion 12 is sized to mate with a corresponding case (see FIGS. 3–6) for the two-piece pushbutton switch. The pair of retaining members 16 are sized to mate with corresponding guides (see FIGS. 3–6) within the case for the two-piece pushbutton switch. The elevated finger button 14, and hence the entire pushbutton switch, is sized for actuation by a human finger. The main body portion 12, the elevated finger button 14, and the pair of retaining members 16 are preferably all fabricated of the same material and from a single mold. A liquid crystal polymer (LCP) known by the trade name VECTRA™ may be used for the molded material, particularly because of its high melting point. Of course, other materials may also be used.

The pair of spring members 18 provide reverse actuation force against the case for the two-piece pushbutton switch. The spring members 18 may be fabricated of the same material and from the same mold as the main body portion 12, the elevated finger button 14, and the pair of retaining members 16, or the spring members 18 may be formed of resilient metal with the molded main body portion 12 providing support therefor.

The conductive contact 20 provides a conductive contact surface for bridging between two corresponding conductive contacts in the case for the two-piece pushbutton switch (see FIGS. 3–6). The conductive contact 20 is preferably fabricated of a conductive elastomer which may be grafted directly to the underside of the main body portion 12. The conductive elastomer may have conductive particles along its surface so as to pierce through any oxide which may have formed on the two corresponding conductive contacts in the case for the two-piece pushbutton switch. Alternatively, the conductive contact 20 may be formed of metal with the molded main body portion 12 providing support therefor.

Figure 3:
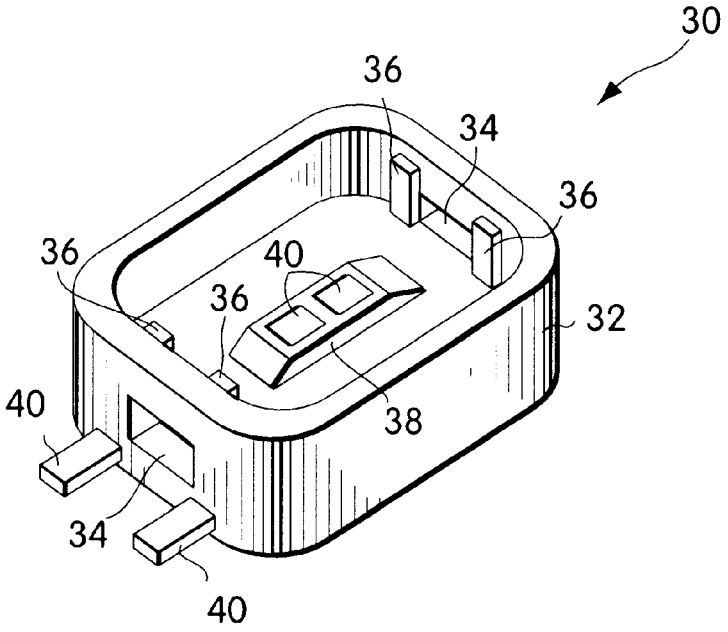
FIG. 3 is a top perspective view of a case for a two-piece pushbutton switch in accordance with the present invention.
Figure 4:
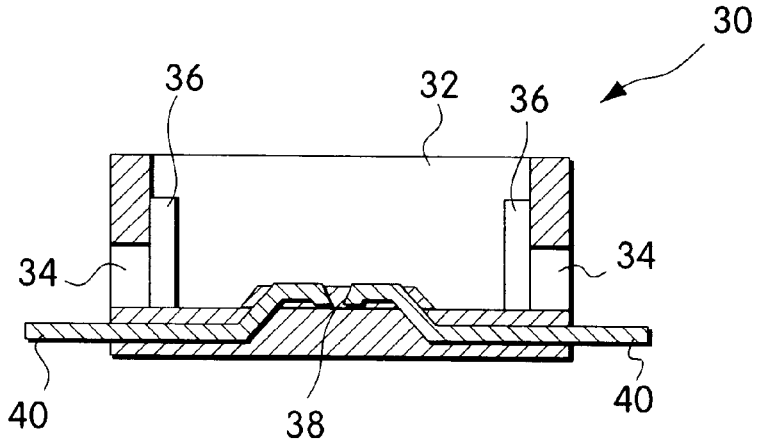
FIG. 4 is a side cross-sectional view of the case shown in FIG. 3.

Referring to FIGS. 3 and 4, there are shown a top perspective view and a side cross-sectional view, respectively, of a case 30 for a two-piece pushbutton switch in accordance with the present invention. The case 30 comprises a hollowed structure 32 having a pair of apertures 34 formed in opposite ends thereof for mating with the retaining members 16 of the actuator 10 (see FIGS. 1 and 2). Bordering each aperture 34 is a pair of guides 36 for guiding the retaining members 16 toward the apertures 34. A protrusion 38 is formed in the center of the case 30 for supporting a pair of conductive terminal contacts 40. Similar to the actuator 10, the case 30, including the hollowed structure 32, the guides 36, and the protrusion 38, is preferably fabricated of an LCP in a single mold. The conductive terminal contacts 40 are preferably fabricated of a copper alloy material, although other materials may also be used.

Figure 5:
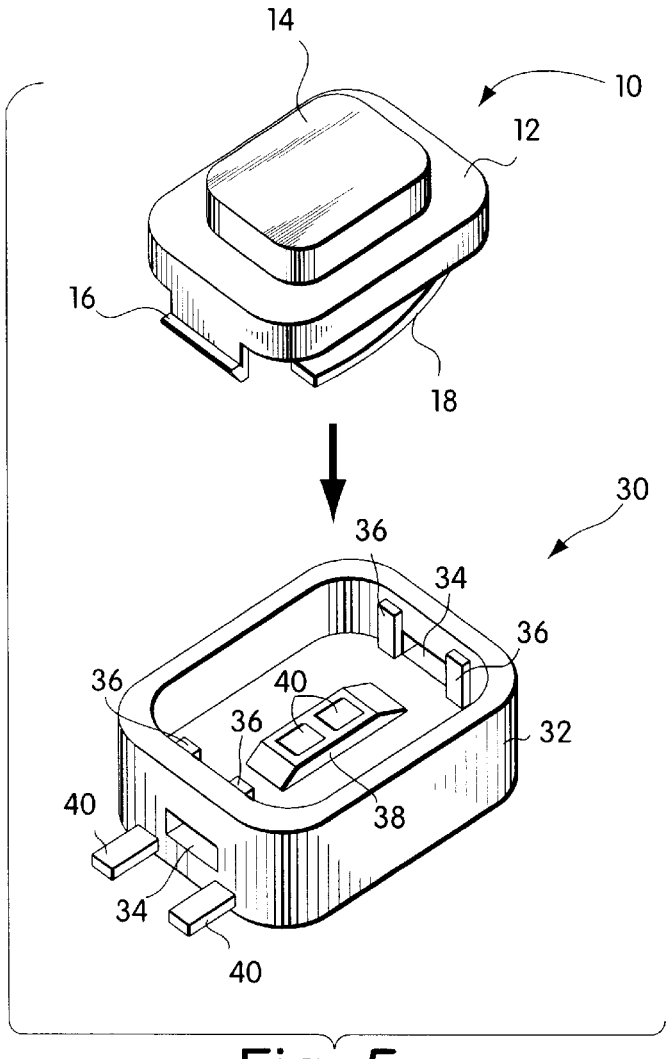
FIG. 5 is an exploded assembly view of the actuator and case shown in FIGS. 1 and 2 and FIGS. 3 and 4, respectively.

Referring to FIG. 5, there is shown an exploded assembly view of the actuator 10 and the case 30 for a two-piece pushbutton switch in accordance with the present invention.

Figure 6:
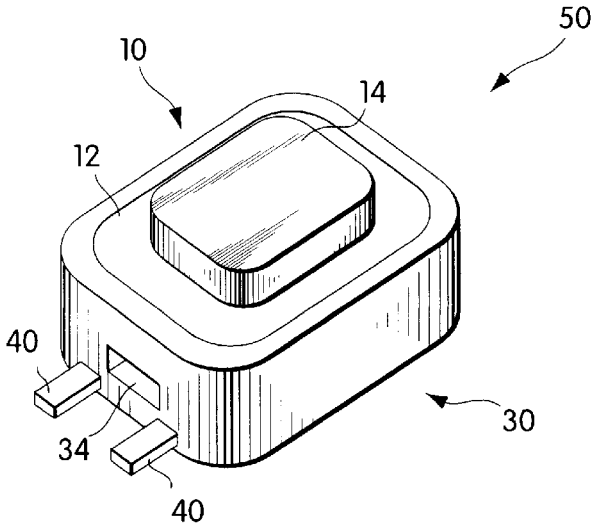
FIG. 6 is top perspective view of a two-piece pushbutton switch 50 in accordance with the present invention.

Referring to FIG. 6, there is shown a top perspective view of a two-piece pushbutton switch 50 in assembled form in accordance with the present invention.

Figure 7:
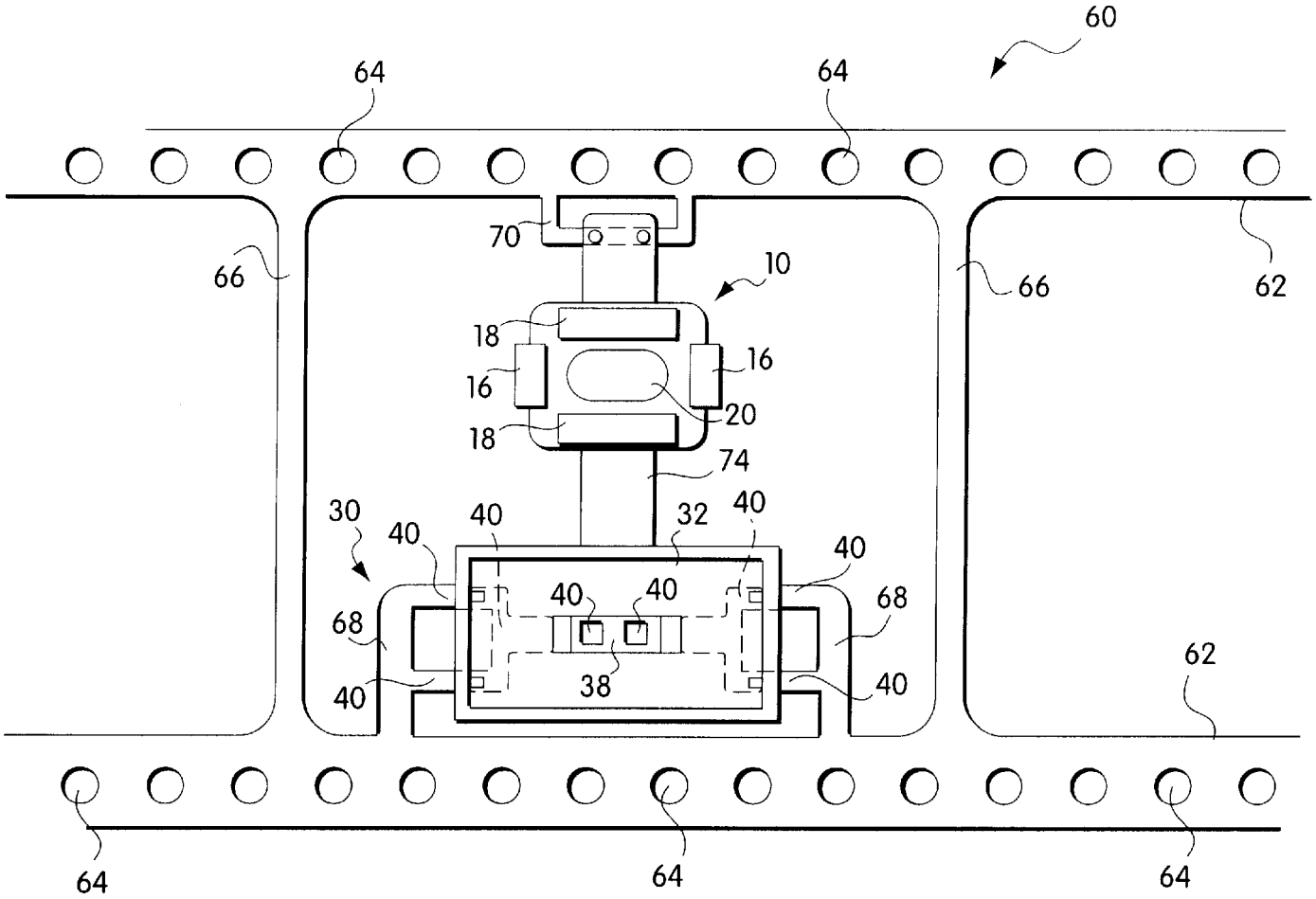
FIG. 7 is a top view of a frame of a double-railed molding assembly for a one-piece molded switch in accordance with the present invention.

Referring to FIG. 7, there is shown a top view of a frame of a double-railed molding assembly 60 for a one-piece molded switch in accordance with the present invention. The molding assembly 60 comprises two metal rails 62 each having apertures 64 formed therein for mating with a sprocket wheel (not shown). The sprocket wheel engages the apertures 64 in order to move the molding assembly 60 toward and/or away from an injection molding machine (not shown). The molding assembly 60 also comprises cross members 66 for maintaining the spacing between the two metal rails 62.

Extending off one of the metal rails 62 are leads 68 for the conductive terminal contacts 40. The leads 68 are cut away from the conductive terminal contacts 40 when the one-piece molded switch is to be used.

Extending off the other metal rail 62 is a metal support member 70 for supporting the actuator 10 through a corresponding molded support member 72. This molded support member 72 is trimmed or broken off when the one-piece molded switch is to be used. Another molded support member 74 provides a connection between the actuator 10 and the case 30. This molded support member 74 is flexible so as to allow the actuator 10 to be folded over into the case 30 when the one-piece molded switch is to be used, thereby fully assembling the one-piece molded switch.

All of the other elements of the molding assembly 60 are similar to those shown and described in FIGS. 1–6, and thus those elements are similarly numerically designated. This includes the spring members 18, which in this embodiment are fabricated of the same material and from the same mold as the main body portion 12 of the actuator 10, and the conductive contact 20, which in this embodiment is fabricated of a conductive elastomer grafted directly to the underside of the main body portion 12 of the actuator 10. The grafting of the conductive elastomer takes place after the molded material has cured.

Figure 8:
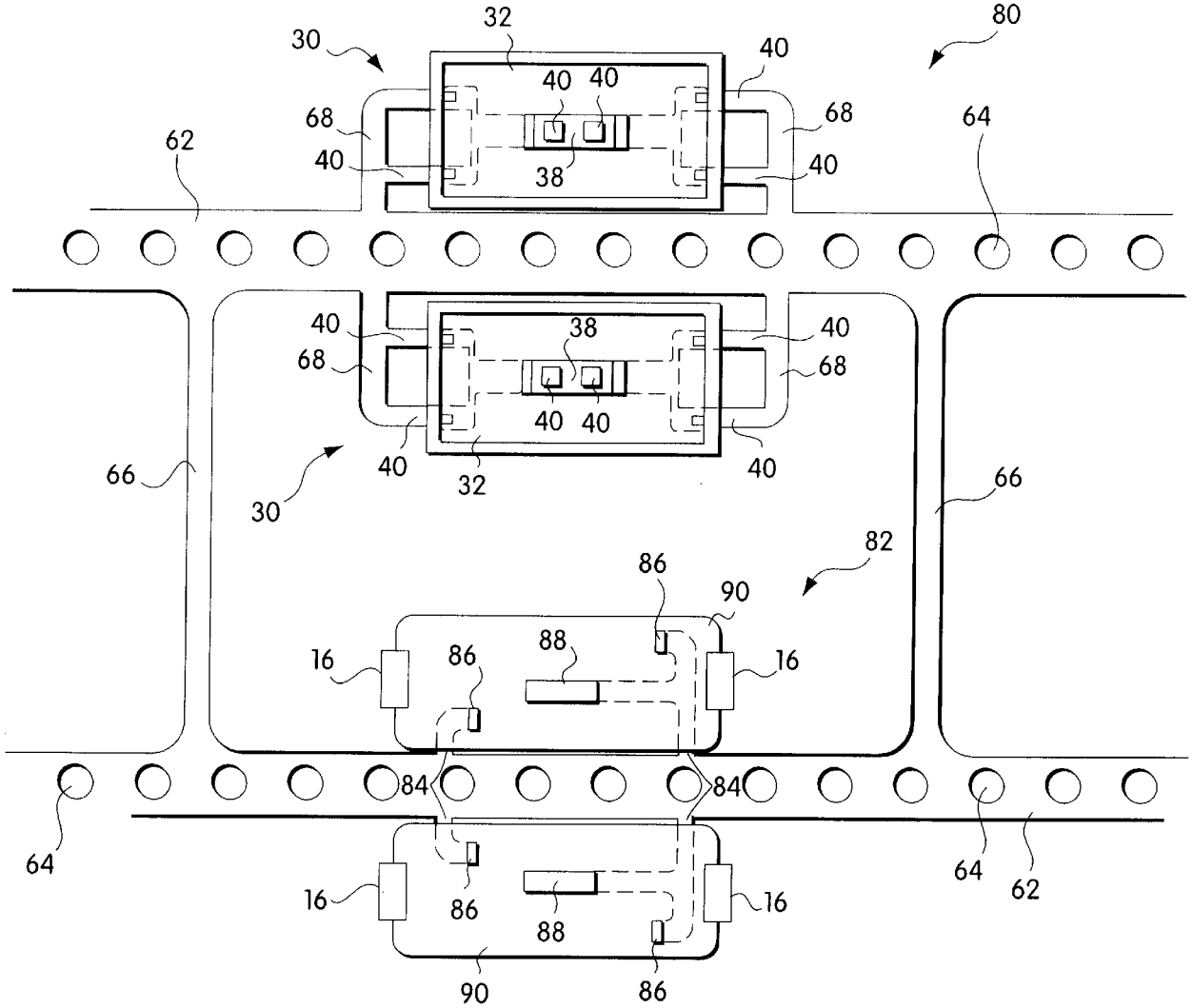
FIG. 8 is a top view of a frame of a double-railed molding assembly for two-piece molded switches in accordance with the present invention.

Referring to FIG. 8, there is shown a top view of a frame of a double-railed molding assembly 80 for two-piece molded switches in accordance with the present invention. The molding assembly 80 comprises elements that are similar to those shown and described in FIG. 7, and thus those elements are similarly numerically designated. The molding assembly 80 also comprises new and additional elements including alternate embodiment actuators 82. Each actuator 82 is connected to one of the metal rails 62 by metal support members 84 which are also used to provide resilient metal spring members 86 and a conductive contact 88. A main body portion 90 is molded around the metal support members 84, and the metal support members 84 are cut away from the main body portion 90 when the actuator 82 is to be used. Similar to the actuator 10 shown in FIGS. 1 and 2, each actuator 82 has retaining members 16.

It should be noted that the molding assembly 80 may be divided into two separate molding assemblies by removing the cross members 66. This may be desirable since having two separate molding assemblies would allow the actuators 82 and the cases 30 to be separately fabricated. It would also decrease the complexity of the die set and mold used in the single molding assembly 80.

Figure 9:
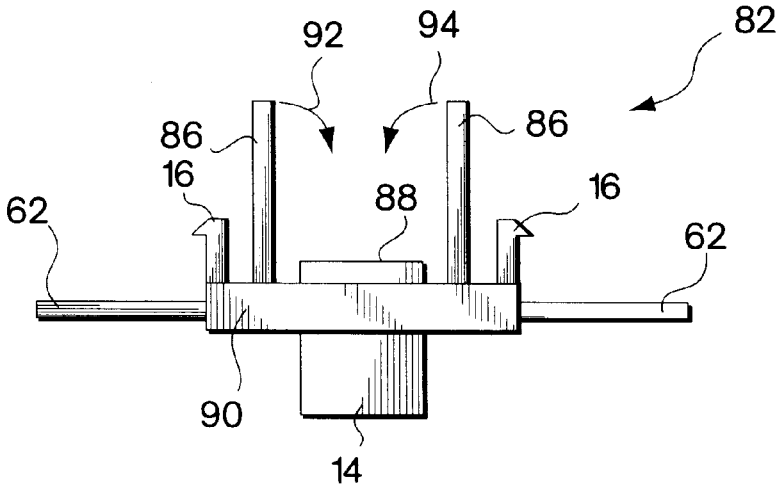
FIG. 9 is a side cross-sectional view of one of the actuators shown in FIG. 8.

Referring to FIG. 9, there is shown a side cross-sectional view of one of the actuators 82 shown in FIG. 8. From this view, it can be seen that the resilient metal spring members 86 are initially in an upright position, but can be bent in the respective directions 92 and 94 so as to be functional when the actuator 82 is mated with a case 30.

Figure 10:
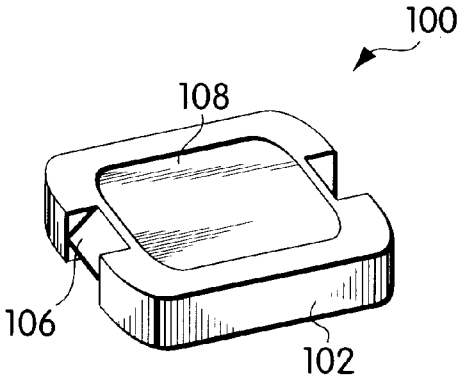
FIG. 10 is a bottom perspective view of an alternate embodiment actuator for a two-piece pushbutton switch in accordance with the present invention.
Figure 11:
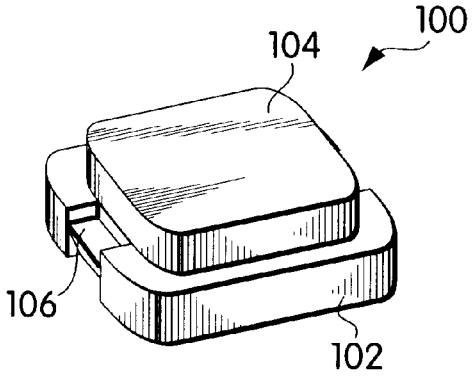
FIG. 11 is a top perspective view of the alternate embodiment actuator shown in FIG. 10.

Referring to FIGS. 10 and 11, there are shown bottom and top perspective views, respectively, of another alternate embodiment actuator 100 for a two-piece pushbutton switch in accordance with the present invention. The actuator 100 comprises a main body portion 102, an elevated finger button 104, a pair of retaining members 106 formed into main body portion 102, and a conductive contact 108. The main body portion 102 is sized to mate with a corresponding case (see FIGS. 13, 14, 17, and 18) for the two-piece pushbutton switch. The pair of retaining members 106 are sized to mate with corresponding snap members (see FIGS. 13, 14, 17, and 18) within the case for the two-piece pushbutton switch. The main body portion 102, the elevated finger button 104, and the pair of retaining members 106 are preferably all fabricated of the same material and from a single mold. As with the case of the actuator 10 shown in FIGS. 1 and 2, the LCP known by the trade name VECTRA™ may be used for the molded material. Of course, other materials may also be used.

The conductive contact 108 provides a conductive contact surface for bridging between two corresponding conductive contacts in the case for the two-piece pushbutton switch (see FIGS. 13, 14, 17, and 18). The conductive contact 20 is preferably fabricated of a conductive elastomer which may be grafted directly to the underside of the main body portion 12. The conductive elastomer may have conductive particles along its surface so as to pierce through any oxide which may have formed on the two corresponding conductive contacts in the case for the two-piece pushbutton switch.

Figure 12:
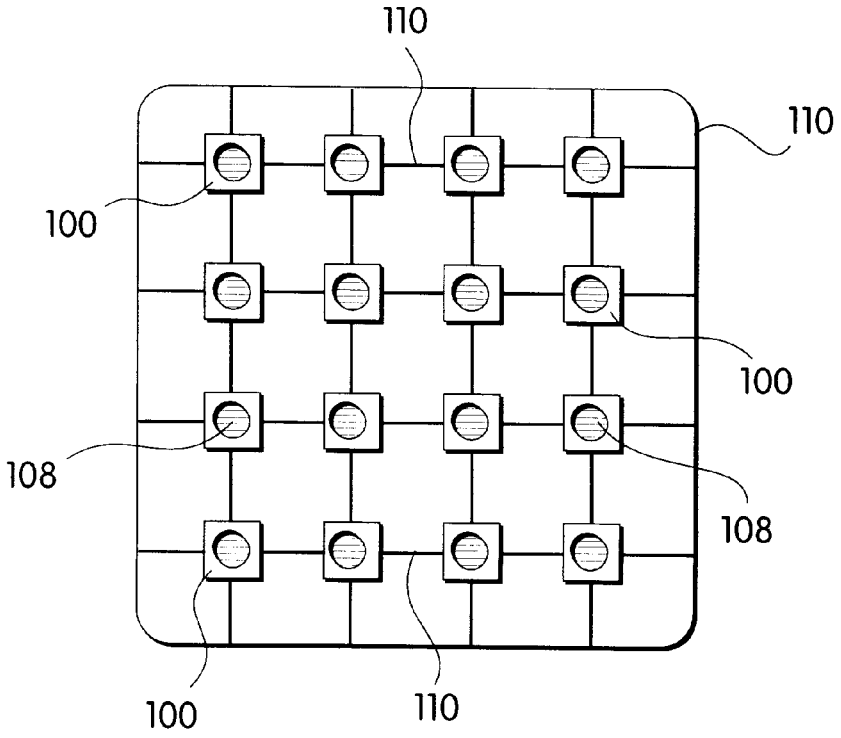
FIG. 12 is a bottom view of a plurality of the alternate embodiment actuator shown in FIG. 10 being held together by a runner system.

Referring to FIG. 12, there is shown a bottom view of a plurality of the alternate embodiment actuators 100 being held together by a runner system 110. The actuators 100 and the runner system 110 are created by a mold which allows molding material such as VECTRA™ to flow along various channels formed in the mold. After drying, the molding material forms the pattern shown in FIG. 12. Also after drying, the conductive contacts 108 are grafted directly to the underside of the actuators 100. The individual actuators 100 are then cut away from the runner system 110 as needed.

Figure 13:
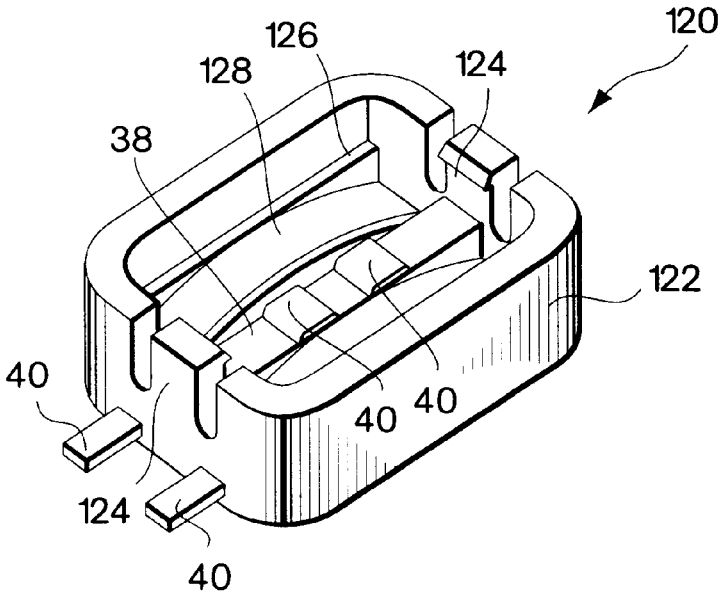
FIG. 13 is a top perspective view of an alternate embodiment case for a two-piece pushbutton switch in accordance with the present invention.
Figure 14:
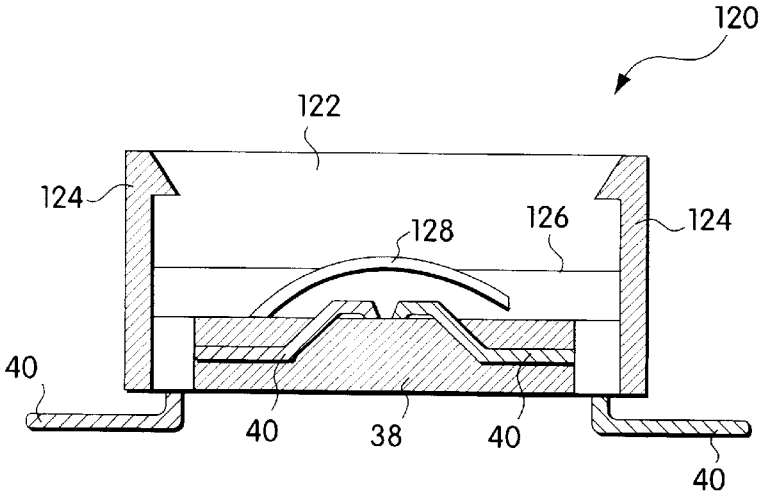
FIG. 14 is a side cross-sectional view of the alternate embodiment case shown in FIG. 13.

Referring to FIGS. 13 and 14, there are shown a top perspective and a side cross-sectional view, respectively, of an alternate embodiment case 120 for mating with the actuator 100 shown in FIGS. 10–12. The case 120 comprises a hollowed structure 122 having a pair of snap members 124 formed in opposite ends thereof for mating with the retaining members 106 of the actuator 100 (see FIGS. 10 and 11). A protrusion 38 is formed in the center of the case 120 for supporting a pair of conductive terminal contacts 40. A pair of protrusions 126 (only one shown) are also formed along the side edges of the case 120 for providing a stop when the actuator 100 is depressed. Both of the conductive terminal contacts 40 are extended to provide a pair of spring members 128 (only one shown), as described in more detail below. Similar to the actuator 100, the case 120, including the hollowed structure 122 and the protrusions 38 and 126, is preferably fabricated of an LCP in a single mold. The conductive terminal contacts 40, including the spring members 128 are preferably fabricated of a copper alloy material, although other materials may also be used.

Figure 15:
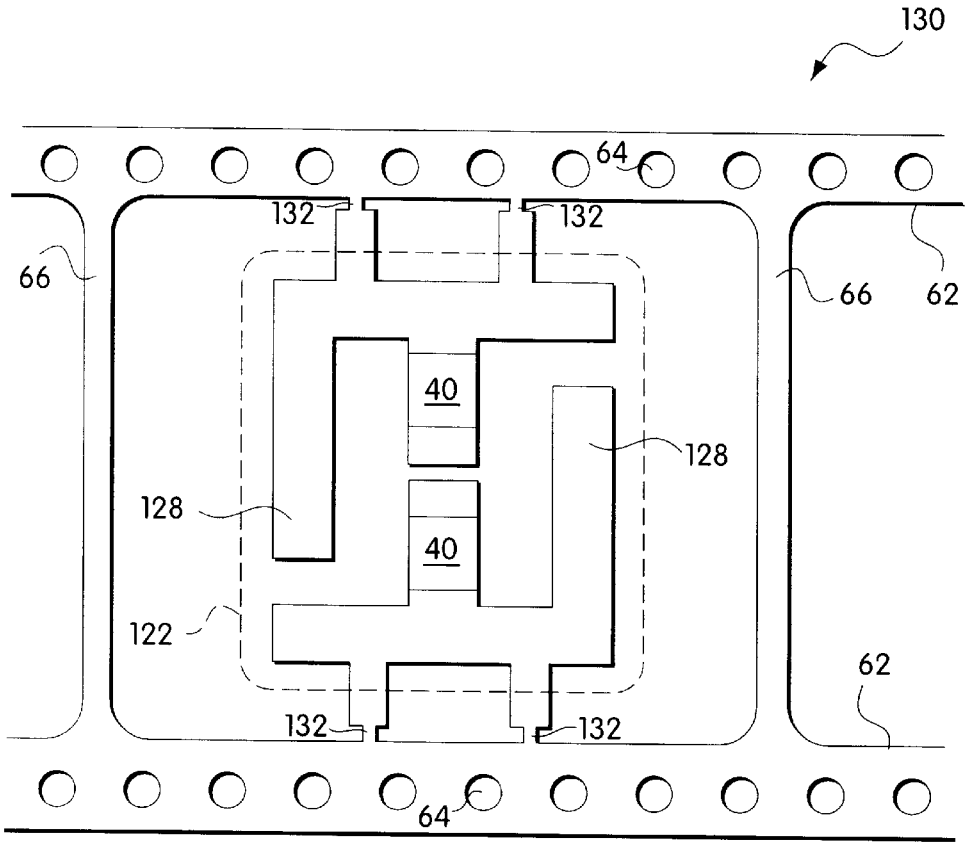
FIG. 15 is a top view of an alternate embodiment molding assembly die for use in fabricating the case shown in FIGS. 13 and 14.
Figure 16:
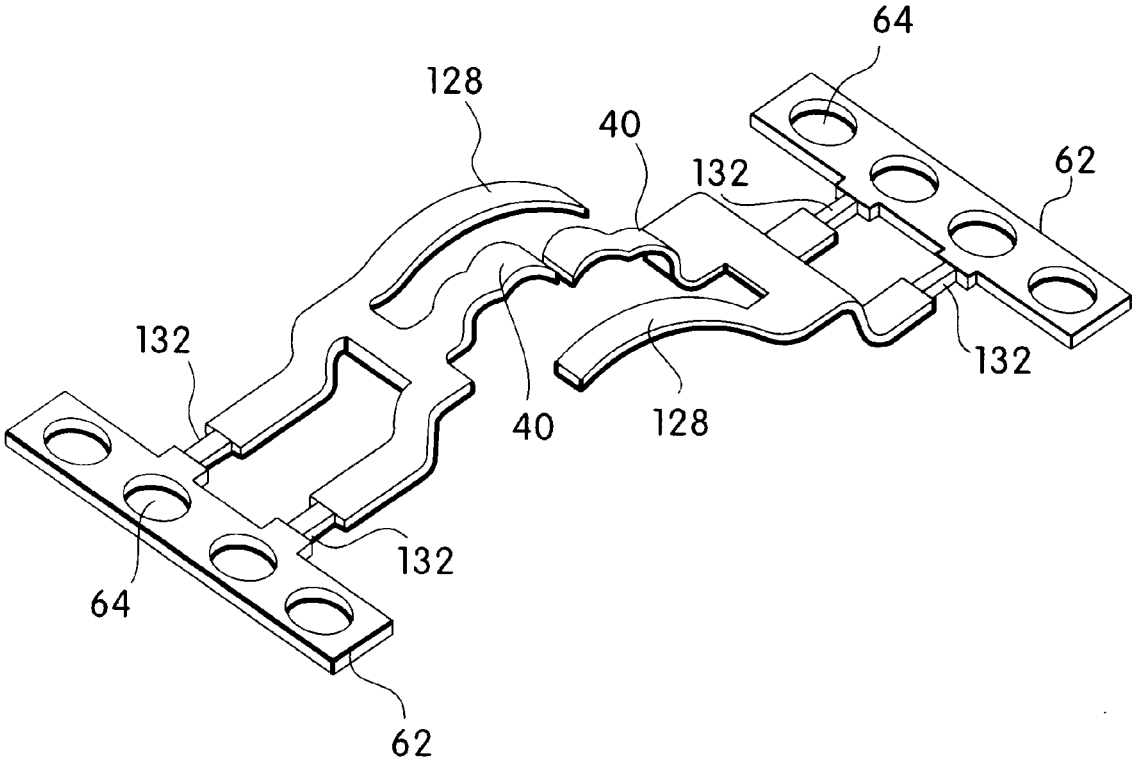
FIG. 16 is a side perspective view of an alternate embodiment molding assembly die for use in fabricating the case shown in FIGS. 13 and 14.

Referring to FIGS. 15 and 16, there are shown a top and a side perspective view, respectively, of an alternate embodiment molding assembly die 130 for use in fabricating the case 120 shown in FIGS. 13 and 14. Similar to the molding assembly 60, the molding assembly die 130 comprises two metal rails 62 each having apertures 64 for mating with a sprocket wheel, and cross members 66 for maintaining the spacing between the two metal rails 62. Extending off each metal rail 62 are leads 132 for the conductive terminal contacts 40. As previously described, both of the conductive terminal contacts 40 are extended to provide the pair of spring members 128. These type of spring members 128 can be referred to as beam spring members.

Figure 17:
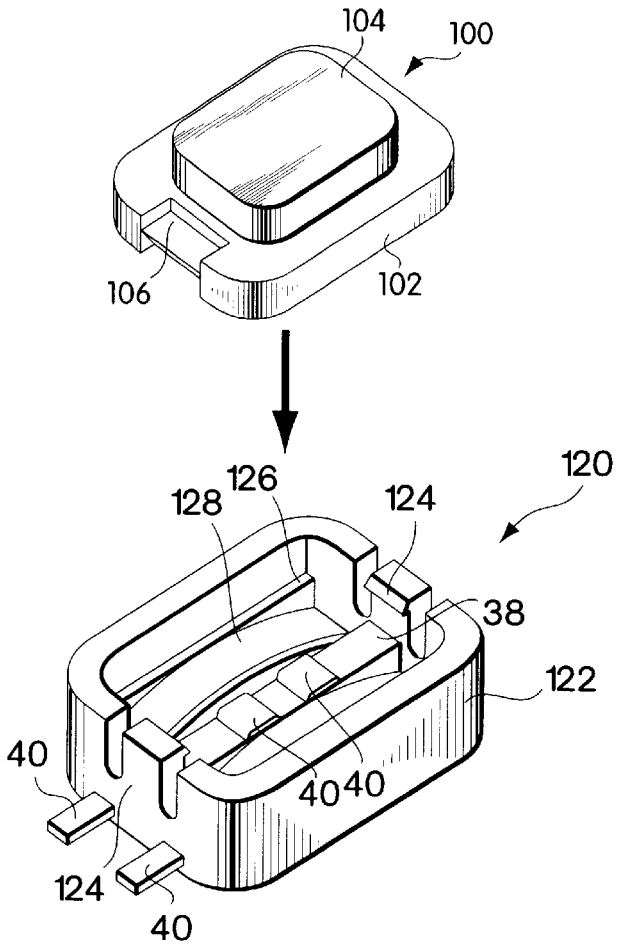
FIG. 17 is an exploded assembly view of the actuator and case shown in FIGS. 10 and 11 and FIGS. 13 and 14, respectively.
Figure 18:
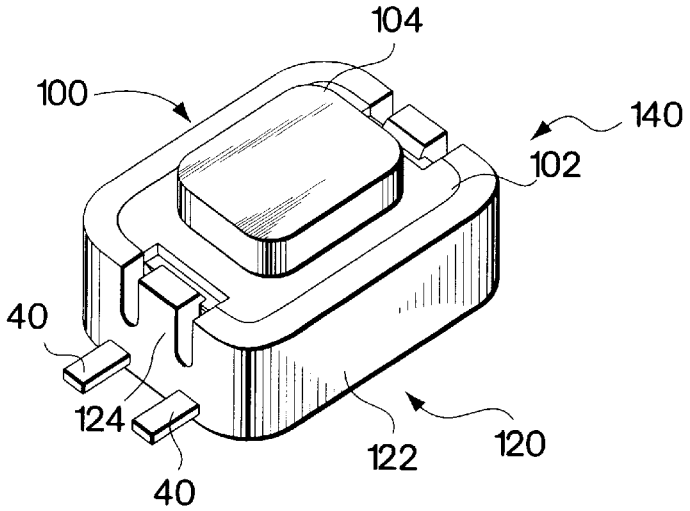
FIG. 18 is top perspective view of a two-piece pushbutton switch in accordance with the present invention.

Referring to FIG. 17, there is shown an exploded assembly view of the actuator 100 and the case 120 for a two-piece pushbutton switch in accordance with the present invention. Referring to FIG. 18, there is shown a top perspective view of a two-piece pushbutton switch 140 in assembled form in accordance with the present invention.

Figure 19:
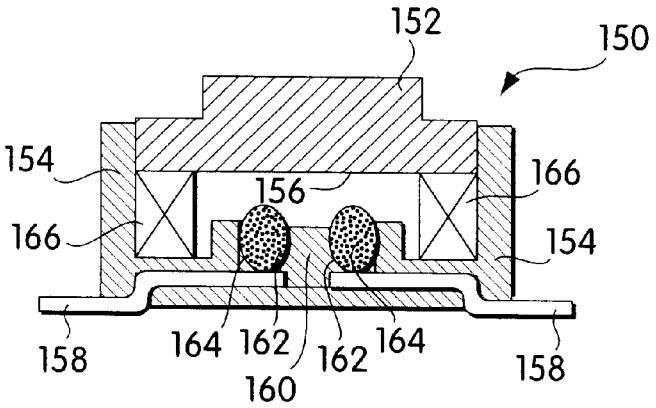
FIG. 19 is a cross-sectional view of an alternate embodiment two-piece pushbutton switch in accordance with the present invention.

Referring to FIG. 19, there is shown a cross-sectional view of a further alternate embodiment two-piece pushbutton switch 150 in accordance with the present invention. Similar to the previously described embodiments, the two-piece pushbutton switch 150 comprises a mating actuator 152 and case 154. The actuator 152 has a conductive contact 156 disposed on its underside, and the case 154 has a conductive terminal contacts 158 formed therein. The case 154 also has a protrusion 160 formed in the center thereof, and two openings 162 are formed in the protrusion 160 extending from the top of the protrusion down to the conductive terminal contacts 158. A barrel-shaped conductive column 164 is disposed within each opening 162 so as to provide an electrical connection between the conductive terminal contacts 158 and the conductive contact 156 when the actuator 152 is depressed. The conductive columns 164 are preferably fabricated of a conductive elastomer. The conductive columns 164 may have conductive particles along their surfaces so as to pierce through any oxide which may have formed on either the conductive terminal contacts 158 and/or the conductive contact 156.

Figure 20:
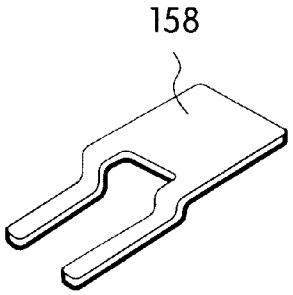
FIG. 20 is a perspective view of a conductive terminal contact for use in a pushbutton switch in accordance with the present invention.
Figure 21:
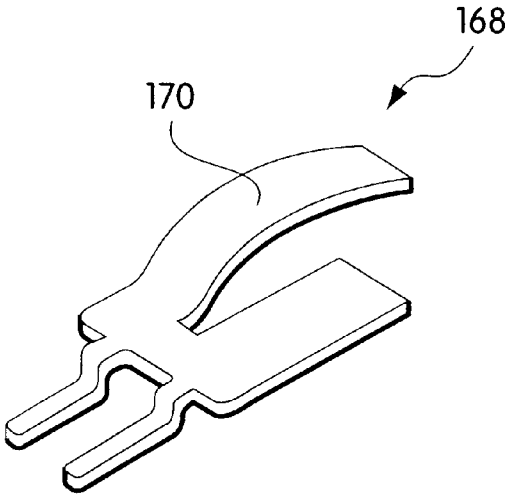
FIG. 21 is a perspective view of a conductive terminal contact having a beam spring member for use in a pushbutton switch in accordance with the present invention.

A spring member 166 is located on each side of the case 154. The spring members 166 may be of the beam spring type as described above, or another type of spring member may be used such as a coil spring. If a coil spring were to be used, the shape of the conductive terminal contact 158 could be as shown in FIG. 20. FIG. 21 shows a conductive terminal contact 168 having a beam spring member 170. This conductive terminal contact 168 has a shape that is slightly different than those that have heretofore been described.

It should be noted that all of the conductive terminal contacts that have heretofore been described have two parallel leads for purposes of coplanarity. The parallel leads also allow the switches to sit flat on a circuit board before soldering. Of course, conductive terminal contacts having single leads may also be used in accordance with the present invention.

The present invention is not to be limited in scope by the specific embodiments described herein. Indeed, various modifications of the present invention, in addition to those described herein, will be apparent to those of skill in the art from the foregoing description and accompanying drawings. Thus, such modifications are intended to fall within the scope of the appended claims.

What is claimed is:

1. An electrical switch comprising:

a case having a pair of conductive terminal contacts extending therefrom; and an actuator for mating with said case, said actuator being movable between a conducting position and a non-conducting position within said case, said actuator having at least one spring member and a conductive contact surface, said at least one spring member forcing said actuator into said non-conducting position, said conductive contact surface formed of a conductive elastomer and grafted to said actuator, said conductive contact surface providing an electrical connection between said pair of conductive terminal contacts when said actuator is in said conducting position.

2. The electrical switch as defined in claim 1, wherein said case has at least one guide for guiding said actuator into said case.

3. The electrical switch as defined in claim 1, wherein said case has at least one snap member for retaining said actuator within said case.

4. The electrical switch as defined in claim 1, wherein said actuator has at least one retaining member for retaining said actuator within said case.

5. The electrical switch as defined in claim 1, wherein said case is formed of a molded material.

6. The electrical switch as defined in claim 5, wherein said case is molded around said pair of conductive terminal contacts.

7. The electrical switch as defined in claim 1, wherein said actuator is formed of a molded material.

8. The electrical switch as defined in claim 7, wherein said at least one spring member is formed of said molded material with said actuator.

9. The electrical switch as defined in claim 7, wherein said at least one spring member is formed of metal, and wherein said actuator is molded around said at least one spring member.

10. The electrical switch as defined in claim 7, wherein said conductive contact surface is formed of metal, and wherein said actuator is molded around said conductive contact surface.

11. The electrical switch as defined in claim 7, wherein said at least one spring member and said conductive contact surface are connected and formed of metal, and wherein said actuator is molded around said at least one spring member and said conductive contact surface.

12. An electrical switch comprising:

a case having at least one spring member, and having a pair of conductive terminal contacts extending therefrom; and an actuator for mating with said case, said actuator being movable between a conducting position and a non-conducting position within said case, said actuator having a conductive contact surface, said at least one spring member forcing said actuator into said non-conducting position, said conductive contact surface formed of a conductive elastomer and grafted to said actuator, said conductive contact surface providing an electrical connection between said pair of conductive terminal contacts when said actuator is in said conducting position.

13. The electrical switch as defined in claim 12, wherein said case has at least one guide for guiding said actuator into said case.

14. The electrical switch as defined in claim 12, wherein said case has at least one snap member for retaining said actuator within said case.

15. The electrical switch as defined in claim 12, wherein said actuator has at least one retaining member for retaining said actuator within said case.

16. The electrical switch as defined in claim 12, wherein said case is formed of a molded material.

17. The electrical switch as defined in claim 16, wherein said case is molded around said pair of conductive terminal contacts.

18. The electrical switch as defined in claim 16, wherein said at least one spring member is formed of said molded material with said case.

19. The electrical switch as defined in claim 16, wherein said at least one spring member is formed of metal, and wherein said case is molded around said at least one spring member.

20. The electrical switch as defined in claim 16, wherein said at least one spring member and said pair of conductive terminal contacts are connected and formed of metal, and wherein said case is molded around said at least one spring member and said conductive terminal contacts.

21. The electrical switch as defined in claim 12, wherein said actuator is formed of a molded material.

22. The electrical switch as defined in claim 21, wherein said conductive contact surface is formed of metal, and wherein said actuator is molded around said conductive contact surface.

23. A one-piece molded electrical switch comprising:

a case having a pair of conductive terminal contacts extending therefrom;

an actuator having at least one spring member and a conductive contact surface, said actuator being movable between a conducting position and a non-conducting position within said case, said at least one spring member forcing said actuator into said non-conducting position, said conductive contact surface formed of a conductive elastomer and grafted to said actuator, said conductive contact surface providing an electrical connection between said pair of conductive terminal contacts when said actuator is in said conducting position; and a molded support member for connecting said case and said actuator.

24. A one-piece molded electrical switch comprising:

a case having at least one spring member and a pair of conductive terminal contacts extending therefrom;

an actuator having a conductive contact surface, said actuator being movable between a conducting position and a non-conducting position within said case, said at least one spring member forcing said actuator into said non-conducting position, said conductive contact surface formed of a conductive elastomer and grafted to said actuator, said conductive contact surface providing an electrical connection between said pair of conductive terminal contacts when said actuator is in said conducting position; and a molded support member for connecting said case and said actuator.

* * * * *